United States Patent [19]

Watkins et al.

[11] 3,966,621

[45] June 29, 1976

[54] LUBRICATING OIL COMPOSITIONS

[75] Inventors: Robert Charles Watkins, Wantage; Derek Alfred Kinghan; Robert Walter Humphrey, both of Didcot, all of England

[73] Assignee: Exxon Research and Engineering Company, Linden, N.J.

[22] Filed: May 12, 1975

[21] Appl. No.: 576,969

[30] Foreign Application Priority Data

May 17, 1974 United Kingdom ..... 22087/74

[52] U.S. Cl. ..... 252/42.7

[51] Int. Cl.[2] ..... C10M 1/54; C10M 3/48; C10M 5/28; C10M 7/52

[58] Field of Search ..... 252/42.7

[56] References Cited

UNITED STATES PATENTS 3,725,381 4/1973 Sakai et al. ..... 252/42.7

*Primary Examiner*—Delbert E. Gantz
*Assistant Examiner*—I. Vaughn
*Attorney, Agent, or Firm*—Frank T. Johmann

[57] ABSTRACT

The preparation of overbased Group II metal sulphurized phenates by reacting the metal base, a sulphurized phenol or phenol sulphur mixture a diol and an alcohol in oil over a controlled temperature cycle, introducing carbon dioxide to the mixture when the temperature is less than 140°C and the water present in the mixture has been reduced to below 0.3% by weight of the mixture.

17 Claims, No Drawings

LUBRICATING OIL COMPOSITIONS

This invention relates to a process for making detergent additives of high basicity suitable for use in lubricating oils.

There is an increasing need for detergent additives in lubricating oils which have high basicity, to neutralize acids formed during engine operation which corrode engine parts. High basicity is particularly desireable in lubricating oils for engines which operate on high sulphur content fuel such as marine diesel engines. This invention is concerned with high basicity phenates commonly known as overbased phenates.

According to this invention a colloidal suspension in oil of a Group II metal carbonate together with a Group II metal sulphurised phenate as dispersant is prepared by a process in which:

1. a reaction mixture is formed comprising
   a. a Group II metal compound
   b. either sulphur and one or more hydrocarbyl substituted phenols wherein the or each hydrocarbyl group contains up to 60 carbon atoms, or one or more sulphurised phenols having one or more hydrocarbyl group substituents, each substituent containing up to 60 carbon atoms.
   c. a diol having a boiling point less than the decomposition temperature of the reaction product
   d. a $C_1$ to $C_{15}$ monoalcohol or a $C_2$ to $C_{20}$ ether alcohol and
   e. oil,
2. the reaction mixture is heated at a temperature of from 100°C to 180°C in 5 to 15 hours, provided the rise in temperature from 150°C to 160°C takes 1 to 4 hours and that from 170°C to 180°C takes 1 to 4 hours,
3. carbon dioxide is introduced into the reaction mixture when the temperature thereof is less than 140°C,
4. before the introduction of carbon dioxide has been completed the amount of water of reaction is reduced to below 0.3 wt.% based on the total weight of the reaction mixture, and thereafter
5. the diol and alcohol or ether alcohol are removed from the reaction mixture.

The Group II metal compound is preferably an oxide or hydroxide but other compounds, e.g. the alcoholate, may be used if desired.

The Group II metal compound is preferably calcium oxide or hydroxide but may if desired be an oxide or hydroxide of barium, strontium or magnesium.

The or each hydrocarbyl substituent in the hydrocarbyl substituted phenol preferably has at least six carbon atoms. Although the hydrocarbyl substituent can be an alkenyl, alkinyl, aryl, aralkyl or alkaryl group, it is preferred that it should be an alkyl group, and especially one containing 9 to 15 carbon atoms e.g. nonyl, decyl, dodecyl, or tetradecyl. Non-alkyl substituents which could be used include dodecenyl, tetradecenyl, phenyl ethyl and benzyl. Mixtures of alkyl phenols include for example a mixture of nonyl phenol and dodecyl phenol.

It is preferred that the phenol be substituted with just one hydrocarbyl group, usually in the para position, but if desired there may be more than one hydrocarbyl substituent.

The hydrocarbyl substituted phenol may have other substituents e.g. halogens such as chlorine or bromine, nitro or sulphonic acid groups.

The sulphur which is used may be solid sulphur such as flowers of sulphur, or it may be molten sulphur and this often has cost and handling advantages. When molten sulphur is used it should be added to the reaction mixture when the temperature thereof is no higher than 110°C otherwise a very viscous, low sulphur content produce will result. The use of molten sulphur is useful in that it tends to give a lower viscosity reaction mixture thus reducing the tendency of the reactants to be blown out of the reaction vessel by the evolution of gasses such as hydrogen sulphide and steam during the reaction. In addition, when using molten sulphur the evolution of hydrogen sulphide has been found at times to be more even.

Instead of using sulphur and a hydrocarbyl substituted phenol one may use a sulphurised phenol and such sulphurised phenols have one or more hydrocarbyl groups as substituents, each substituent having not more than 60 carbon atoms. The preferred sulphurised phenols correspond to the hydrocarbyl substituted phenols set out above and ones having one hydrocarbyl group containing for example 9 to 15 carbon atoms, per benzene ring, preferably in the para position with respect to the hydroxyl group are preferred. There may be 1, 2, 3 or 4 sulphur atoms in the bridge linking two phenyl groups.

Although any diol may be used (provided its boiling point is less than the decomposition temperature of the reaction product) it is preferred to use one containing 2 to 10 carbon atoms, e.g. 2 to 6 carbon atoms such as propylene glycol, butane diol-2,3, pentane diol-2,3 or 2-methyl butane diol-3,4. The most preferred glycol is however ethylene glycol.

The $C_1$ to $C_{15}$ monoalcohol may be a primary alcohol, for example ethanol, hexanol, octanol, nonanol, dodecanol or tetradecanol. For this process it is preferred to use the higher boiling alcohols, e.g. those boiling above 150°C, usually $C_6$ to $C_{15}$ monoalcohols. A particularly suitable monoalcohol is tridecanol.

As an alternative to the $C_1$ to $C_{15}$ monoalcohol or if desired in addition, one can use a $C_2$ to $C_{20}$ ether alcohol. These ether alcohols may be monoalkyl ethers of ethylene glycol such as the methyl or ethyl ethers of ethylene glycol. They could equally well be the monoalkyl ethers (e.g. methyl or ethyl) of other glycols such as propylene glycol and butylene glycol. Alternatively one could use a monoalkyl ether of diethylene glycol.

The oil can be any diluent oil, such as a hydrocarbon oil, e.g. of mineral origin. Oils which have viscosities of 15 to 30cS at 100°F are very suitable. Alternatively one could use a lubricating oil and these are described later in the specification.

The relative quantities of the components of the reaction mixture can vary to quite an extent. It is necessary to have the diol to solubilise the Group II metal compound and to have the monoalcohol or ether alcohol to provide a single phase system, the single phase comprising the oil, glycol, Group II metal compound, the hydrocarbyl substituted phenol or sulphurised phenol and alcohol.

In practice it is desirable to decide the relative amounts of Group II metal compound and hydrocarbyl substituted phenol or sulphurised phenol according to the TBN (total base number) desired for the overbased additive. The amount of Group II metal compound governs the amount of diol required. The amount of monoalcohol or ether alcohol required is determined to some extent by the nature of the diol, its amount and the amount of oil. The amount of oil is governed by the requirement for a workable reaction medium of suitable viscosity as well as its amount in the final product, the finished product typically being about 70 wt.% active matter.

In a typical reaction mixture the amounts of reactants are as follows:

| | Molar Proportion |
|---|---|
| Hydrocarbyl substituted phenol | 0.5 – 1.5 |
| Diol | 1.75–2.25 |
| Alcohol or ether alcohol | 0.25–0.75 |
| Sulphur | 1.75–2.25 |
| Group II metal compound | 1.25–2.00 |
| Oil - about 15–20 wt.% of total weight or reaction mixture. | |

In preparing the reaction mixture when the Group II metal compound is an oxide or hydroxide there must be sufficient diol already in the reactor to form the diolate when the oxide or hydroxide is added, i.e. there must be a molar equivalent or excess of diol present in the reactor. It is also preferred to have the hydrocarbyl substituted phenol and alcohol already present as well before the oxide or hydroxide is added. This ensures that the temperature of the reaction mixture rises to about 110°C due to the exothermic formation of the diolate of the Group II metal e.g. calcium glycolate. The oil may then be added to the reactor at this stage.

The reaction mixture is heated from 110°C to 180°C in 5 to 15 hours, preferably 7 to 10 hours. The temperature must rise from 150°C to 160°C in 1 to 4 hours preferably 2 to 3 hours and from 170°C to 180°C in 1 to 4 hours, preferably 2 to 3 hours. At 150°C to 160°C most of the water reaction is removed and this must be carefully controlled and too rigid a rate avoided otherwise reactants themselves will be "blown" out of the reactor. At 170°C to 180°C most of the $H_2S$ is evolved and again this must be controlled and too rapid a rate prevented.

Carbonation takes place by introducing carbon dioxide into the reaction mixture. This must take place when the temperature of the reaction mixture is below 140°C preferably at about 110°C. By controlling the temperature at which carbonation takes place one prevents premature sulphurisation and prevents the reaction mixture from becoming too viscous, hence reducing the need for oil and alcohol or ether alcohol.

In order to achieve small colloidal particle size the rate at which carbon dioxide reacts with the reactants should preferably be less than 0.2 and preferably less than 0.1 moles of $Co_2$ per mole of Group II metal compound per hour. A typical rate is about 0.05 moles of $CO_2$ per mole of Group II metal compound per hour. The rate of reaction is easily determined by subtracting the rate of evolution of $CO_2$ from the rate at which $CO_2$ is introduced into the reaction mixture.

Before the carbonation has been completed it is necessary to ensure that the amount of water of reaction is reduced to below 0.3 wt.% based on the total weight of the reaction mixture. If this is not done the Group II metal sulphurised phenate hydrolyses to the sulphurised phenol and Group II metal carbonate precipitates. The required reduction in the amount of the water of reaction can be achieved by a nitrogen purge during carbonation of up to 25% of the rate of introduction of the carbon dioxide. Alternatively one can stop carbonating, strip off water using nitrogen and or vacuum and then complete the carbonation when the water content is below 0.3 wt.%.

The diol and alcohol or ether alcohol are removed from the reaction mixture. This can be done by distillation. If however relatively high boiling point alcohol or ether alcohol has been used in the reaction its removal is difficult without exceeding the decomposition temperature of the desired product, e.g. calcium sulphurised phenate. This problem can be overcome when the diol has a boiling point lower than that of the alcohol or ether alcohol by recycling the diol and using the diol/ether or diol/ether alcohol azeotrope to remove the alcohol or ether alcohol before stripping out the diol.

The desired product is found to be a colloidal suspension in oil of Group II metal carbonate together with Group II metal sulphurised phenate as dispersant, the average diameter of the colloid particles being less than 60 A. Usually the finished product is 60–80%, e.g. 70% active ingredient in oil. Its TBN can vary from 150 to 500, usually 200–300, e.g. 240–260. The structure of the Group II metal sulphurised phenate is as follows:

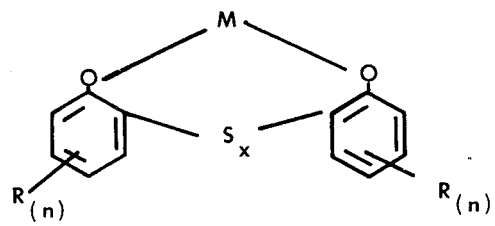

where M is the Group II metal, R is a hydrocarbyl group, $n$ is 1, 2, 3 or 4, and $x$ is 1, 2, 3 or 4. The final product can be a mixture of such phenates where $x$ is different for different molecules.

The overbased detergent additives prepared by the process of this invention are very suitable for use in lubricating oils. The lubricating oils can be any animal, vegetable or mineral oil, for example petroleum oil to SAE 30, 40 or 50 lubricating oil grades, caster oil, fish oils or oxidised mineral oil.

Alternatively the lubricating oil can be a synthetic ester lubricating oil and these include diesters such as di-octyl adipate, di-octyl sebacate, didecyl azelate, tridecyl adipate, didecyl succinate, didecyl glutarate and mixtures thereof. Alternatively the synthetic ester can be a polyester such as that prepared by reacting polyhydric alcohols such as trimethylolpropane and pentaerythritol with monocarboxylic acids such as butyric acid to give the corresponding tri- and tetra- esters. Also complex esters may be used, such as those formed by esterification reactions between a carboxylic acid, a glycol and an alcohol or a monocarboxylic acid.

The amount of overbased detergent added to the lubricating oil should be a minor proportion, e.g. between 0.01% and 30% by weight, preferably between 0.1% and 5% by weight. These proportions refer to the additive concentrate consisting of 70 wt.% metal carbonate plus sulphurised phenate and 30 wt.% oil.

In order to improve the solubility and reduce the foaming it is often desirable to add to the detergent additive small quantities of a glycol such as ethylene glycol, diethylene glycol, trimethylene glycol and propylene glycol, and a long chain carboxylic acid or anhydride, e.g. polyisobutenyl succinic anhydride where the polyisobutenyl chain has a molecular weight of from 700 to 1200 and polyisobutenyl acrylic acid of molecular weight of from 700 to 1200.

The final lubricating oil composition may if desired contain other additives, e.g. a VI improver such as ethylene-propylene copolymers, an overbased calcium sulphonate, magnesium phenate, or a dispersant such as polyisobutenyl succinimide.

EXAMPLE

Ethylene glycol, dodecylphenol, tridecanol and sulphur were charged to the reactor. Lime was added and the temperature of the reactants rose to about 110°C due to the exothermic formation of calcium glycolate. The first charge of diluent oil was added and the mixture was carbonated over 10 to 12 hours, with nitrogen sparging (25% of $CO_2$ rate) to complete water removal. During this period the temperature rose from 110°C to 150°C in 2 hours, 150°C to 160°C in 2 hours, 160°C to 170°C in 1 hour and 170°C to 180°C in 2 hours, and water and $H_2S$ were evolved. when the reaction temperature was less than 140°C carbon dioxide reacted at the rate of about 0.05 moles $CO_2$ per mole of calcium oxide per hour.

At the end of carbonation, glycol and tridecanol were removed, the tridecanol by azeotroping with glycol. Maximum stripping temperature was 210°C and vacuum was used to help remove the solvents. Glycol recovery was 30–40% and tridecanol recovery 90–95%; these solvents being used for further batches. The unrecovered glycol has been shown to be chemically bound to the benzene rings of the phenol. The TBN of the product was found to be about 250.

The second charge of diluent oil was then added and the product filtered. 3½ wt.% of ethylene glycol and 3½ wt.% polyisobutenyl succinic anhydride or molecular weight about 1000 (PIBSA) and more oil were then blended into the product to give the required total base number.

Reactants

| | Mols | Wt.% |
|---|---|---|
| Dodecylphenol | 1.00 | 31.33 |
| Ethylene glycol | 2.11 | 15.64 |
| Tridecanol | 0.66 | 15.64 |
| Sulphur | 1.91 | 7.29 |
| Calcium oxide | 1.69 | 11.29 |
| Oil | — | 18.81 |

14% by weight of the above product together with 11.7% by weight of other suitable overbased additives in oil were incorporated into a lubricating oil to give a high TBN cylinder oil. This high TBN cylinder oil was then used in a Marine Test Engine run continuously on heavy fuel oil for 500 hours. The results of the test were found to be entirely acceptable both as regards ring-wear in the engine and deposits.

What we claim is:

1. A process for the preparation of a colloidal suspension in oil of a Group II metal carbonate together with a Group II metal sulphurised phenate as dispersant in which
   1. a reaction mixture is formed comprising
      a. a Group II metal base compound,
      b. either sulphur and one or more hydrocarbyl substituted phenols, wherein the or each hydrocarbyl group contains up to 60 carbon atoms or one or more sulphurised phenols having one or more hydrocarbyl group substituents, each substituent containing up to 60 carbon atoms, c. a diol having a boiling point less than the decomposition temperature of the reaction product,
      d. a $C_1$ to $C_{15}$ monoalcohol or a $C_2$ to $C_{20}$ ether alcohol and
      e. oil
   2. the reaction mixture is heated at a temperature of from 110° to 180°C in 5 to 15 hours, provided the rise in temperature from 150° to 160°C takes 1 to 4 hours, and that from 170° to 180°C takes 1 to 4 hours,
   3. carbon dioxide is introduced into the reaction mixture when the temperature thereof is less than 140°C,
   4. before the introduction of carbon dioxide has been completed the amount of water of reaction is reduced to below 0.3 wt.% based on the total weight of the reaction mixture, and thereafter
   5. the diol and alcohol or ether alcohol are removed from the reaction mixture.

2. A process according to claim 1 wherein the Group II metal base compound is a Group II metal oxide or hydroxide.

3. A process according to claim 2 wherein the oxide or hydroxide is calcium oxide or calcium hydroxide.

4. A process according to claim 1 wherein the hydrocarbyl substituted phenol is a phenol having one or more $C_9$ to $C_{15}$ alkyl substituents.

5. A process according to claim 1 wherein molten sulphur is added to the reaction mixture when the temperature thereof is no higher than 110°C.

6. A process according to claim 1 wherein the diol is ethylene glycol.

7. A process according to claim 1 wherein the monoalcohol is a $C_6$ to $C_{15}$ monoalcohol.

8. A process according to claim 1 wherein the molar proportions of the reactants in the reaction mixture are as follows:

| | |
|---|---|
| Hydrocarbyl substituted phenol | 0-5–1.5 |
| Diol | 1.75–2.25 |
| Alcohol or ether alcohol | 0.25–0.75 |
| Sulphur | 1.75–2.25 |
| Group II metal base compound | 1.25–2.00. |

9. A process according to claim 1 wherein the reaction mixture is heated from 110°C to 180°C in 7 to 10 hours.

10. A process according to claim 1 wherein the required reduction in the amount of water of reaction is effected by a nitrogen purge during carbonation of up to 25% of the rate of introduction of carbon dioxide.

11. A process according to claim 1 wherein carbon dioxide is reacted at a rate of not more than 0.2 moles per mole of Group II metal base compound per hour.

12. A process according to claim 11 wherein the carbon dioxide reacts at less than 0.1 moles of $CO_2$ per mole of Group II metal base compound per hour.

13. A process according to claim 1 in which component (b) is molten sulphur.

14. A colloidal suspension in oil of Group II metal carbonate together with a Group II metal sulphurised phenate as dispersant whenever prepared by the process according to claim 1.

15. A colloidal suspension in oil and dispersant according to claim 14 having a TBN of 200 to 300.

16. A lubricating oil composition comprising a major proportion by weight of lubricating oil and a minor proportion by weight of the colloidal suspension and dispersant according to claim 14.

17. A composition according to claim 16 which contains 0.01 to 10% by weight of the colloidal suspension and dispersant.

* * * * *